US009046052B2

(12) United States Patent
Eser et al.

(10) Patent No.: US 9,046,052 B2
(45) Date of Patent: Jun. 2, 2015

(54) METHOD FOR CONTROLLING A FUEL PRESSURE IN A FUEL SUPPLY DEVICE OF A COMBUSTION ENGINE

(75) Inventors: Gerhard Eser, Hemau (DE); Martin Wiest, Stuttgart-Uhlbach (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 372 days.

(21) Appl. No.: 10/553,379

(22) PCT Filed: Mar. 12, 2004

(86) PCT No.: PCT/EP2004/002619

§ 371 (c)(1),
(2), (4) Date: Oct. 18, 2005

(87) PCT Pub. No.: WO2004/094806

PCT Pub. Date: Nov. 4, 2004

(65) Prior Publication Data

US 2006/0225707 A1 Oct. 12, 2006

(30) Foreign Application Priority Data

Apr. 24, 2003 (DE) ..... 103 18 646

(51) Int. Cl.
*F02D 41/38* (2006.01)
*F02D 41/12* (2006.01)
*F02D 41/30* (2006.01)

(52) U.S. Cl.
CPC ..... *F02D 41/3863* (2013.01); *F02D 41/3845* (2013.01); *F02D 41/3836* (2013.01); *F02D 41/123* (2013.01); *F02D 41/3029* (2013.01); *F02D 2250/31* (2013.01)

(58) Field of Classification Search
CPC ..... G05D 16/20; G05D 16/2006; G05D 16/2013; G05D 16/202; G05D 16/00; F02D 41/30; F02D 41/3005; F02D 41/38; F02D 41/3809; F02D 41/3836; F02D 41/3845; F02D 41/3818; F02D 41/3827
USPC ..... 123/458, 494, 514, 497, 357, 506, 456, 123/454, 511, 512, 457, 459, 463, 447; 701/101, 102, 104; 138/26, 30; 73/114.43
See application file for complete search history.

(56) References Cited

U.S. PATENT DOCUMENTS 4,633,837 A 1/1987 Babitzka et al.
4,720,807 A * 1/1988 Ferran et al. ..... 700/282
(Continued)

FOREIGN PATENT DOCUMENTS

DE 3436768 A1 4/1986
DE 196 07 070 A1 8/1997
(Continued)

OTHER PUBLICATIONS

Handbuch Verbrennungsmotor, Grundlagen, Komponenten, Systeme, Perspektiven;, 2002, p. 402; Friedrich Vieweg & Sohn Verlagsgesellschaft mbH; Braunschweig/Wiesbaden.
(Continued)

*Primary Examiner* — Lindsay Low
*Assistant Examiner* — Jacob Amick
(74) *Attorney, Agent, or Firm* — King & Spalding L.L.P.

(57) ABSTRACT

A fuel supply device of a combustion engine compromises a fuel pump that pumps fuel into a fuel accumulator, which provides injection valves with fuel and which is connected to a regulator valve that sets the fuel pressure according to an actuating signal (SG). The fuel pressure in the supply device is controlled in such a manner that the actuating signal (SG) is determined according to a desired fuel pressure (FUP_SP) and to quantity that characterizes the dynamics of the flow of the fuel through the regulator valve, and the regulator valve is subsequently controlled by the actuating signal (SG).

16 Claims, 3 Drawing Sheets

(56) References Cited

U.S. PATENT DOCUMENTS

| | | | | |
|---|---|---|---|---|
| 4,757,795 | A * | 7/1988 | Kelly | 123/506 |
| 5,345,916 | A * | 9/1994 | Amann et al. | 123/506 |
| 5,485,820 | A | 1/1996 | Iwaszkiewicz | |
| 5,642,716 | A * | 7/1997 | Ricco | 123/456 |
| 5,758,622 | A * | 6/1998 | Rembold et al. | 123/456 |
| 5,771,861 | A * | 6/1998 | Musser et al. | 123/357 |
| 5,954,030 | A * | 9/1999 | Sturman et al. | 123/446 |
| 6,142,120 | A * | 11/2000 | Biester et al. | 123/456 |
| 6,378,501 | B1 * | 4/2002 | Hisato et al. | 123/458 |
| 6,684,854 | B2 * | 2/2004 | Coldren et al. | 123/446 |
| 6,715,470 | B2 * | 4/2004 | Takahashi | 123/458 |
| 6,761,149 | B2 * | 7/2004 | Frank | 123/456 |
| 6,889,666 | B2 * | 5/2005 | Oono | 123/514 |
| 6,912,983 | B2 * | 7/2005 | Okamoto et al. | 123/179.16 |
| 2003/0047168 | A1 * | 3/2003 | Frank | 123/447 |
| 2003/0051709 | A1 * | 3/2003 | Yu | 123/458 |
| 2003/0217737 | A1 * | 11/2003 | Ismailov | 123/494 |
| 2004/0237937 | A1 * | 12/2004 | Joos et al. | 123/457 |
| 2005/0224051 | A1 * | 10/2005 | Joos et al. | 123/458 |

FOREIGN PATENT DOCUMENTS

| | | | |
|---|---|---|---|
| DE | 197 31 994 | A1 | 1/1999 |
| DE | 100 16 900 | A1 | 11/2001 |
| DE | 101 12 702 | A1 | 10/2002 |
| DE | 101 31 507 | A1 | 1/2003 |
| GB | 2 327 778 | A | 2/1999 |
| GB | 2 378 773 | A | 2/2003 |

OTHER PUBLICATIONS

Grundlagen der Regelungstechnik; G. Schmidt, 1989, p. 165; Springer-Verlag, Berlin Heidelberg, Germany.

* cited by examiner

METHOD FOR CONTROLLING A FUEL PRESSURE IN A FUEL SUPPLY DEVICE OF A COMBUSTION ENGINE

CROSS REFERENCE TO RELATED APPLICATION

This application is the US National Stage of International Application No. PCT/EP2004/002619, filed Mar. 12, 2004 and claims the benefit thereof. The International Application claims the benefits of German Patent application No. 10318646.8 DE filed Apr. 24, 2003, both of the applications are incorporated by reference herein in their entirety.

FIELD OF THE INVENTION

The invention relates to a method for controlling a fuel pressure in a fuel supply device of an internal combustion engine.

BACKGROUND OF THE INVENTION

A fuel supply device for an internal combustion engine is known from the Handbuch Verbrennungsmotor (Internal Combustion Engine Manual), Friedrich Vieweg & Sohn Verlagsgesellschaft mbH, Braunschweig/Wiesbaden, 2002, ISBN 3-528-03933-7, page 402. The supply device has a fuel pump which pumps fuel into a fuel accumulator which supplies injection valves with fuel and which is actively connected to a regulator valve which adjusts the fuel pressure as a function of an actuating signal of an engine control unit. However, the document contains no indication of how the regulator valve is to be controlled.

DE 100 16 900 A1 (D1) discloses a method for feedback control of the accumulator pressure obtaining in a pressure accumulator of a fuel metering system by means of an electrically controlled pressure control valve via which fuel [can be fed] from a pressure accumulator in[to] the low pressure area of the fuel metering system in order to reduce the accumulator pressure. Upstream of the control loop there is provided a pilot control arrangement whereby, as part of pilot control, the electrical control of the pressure control valve is determined as a function of the flow rate through the pressure control valve and the accumulator pressure, or the accumulator pressure establishing itself in the pressure accumulator is determined as a function of the flow rate through the pressure control valve and of the electrical control of the pressure control valve.

SUMMARY OF THE INVENTION

The object of the invention is to create a method for controlling a fuel pressure in a fuel supply device of an internal combustion engine which ensures that the fuel pressure can be precisely adjusted independently of the operating state of the engine.

This object is achieved by the features of the independent claims. Advantageous embodiments of the invention are set forth in the subclaims.

The invention is based on the knowledge that, in the case of a highly dynamic flow of fuel through the regulator valve, undesirable pressure peaks occur if the actuating signal for the regulator valve is set only on the basis of a static flow of fuel through the regulator valve. Such a highly dynamic flow of fuel through the regulator valve generally occurs when the engine is switched from a normal operating mode to idle mode or overrun cutoff or vice versa. For operating state transitions of this kind, the fuel pressure can only be very imprecisely adjusted. By determining the actuating signal for the regulator valve as a function of a desired fuel pressure and of a variable characterizing the dynamics of the flow of fuel through the regulator valve, the fuel pressure can be very accurately adjusted independently of the operating state of the engine. The variation in the flow rate or the variation in the fuel pressure is used as the variable characterizing the dynamics of the flow of fuel through the regulator valve. This is particularly simple, as a pressure sensor for detecting the fuel pressure is generally present in any case in the fuel supply device and its measurement signal can thus be easily analyzed.

BRIEF DESCRIPTION OF THE FIGURES

Examples of the invention will now be explained with reference to the schematic drawings in which.

DETAILED DESCRIPTION OF THE INVENTION

Figure 1:
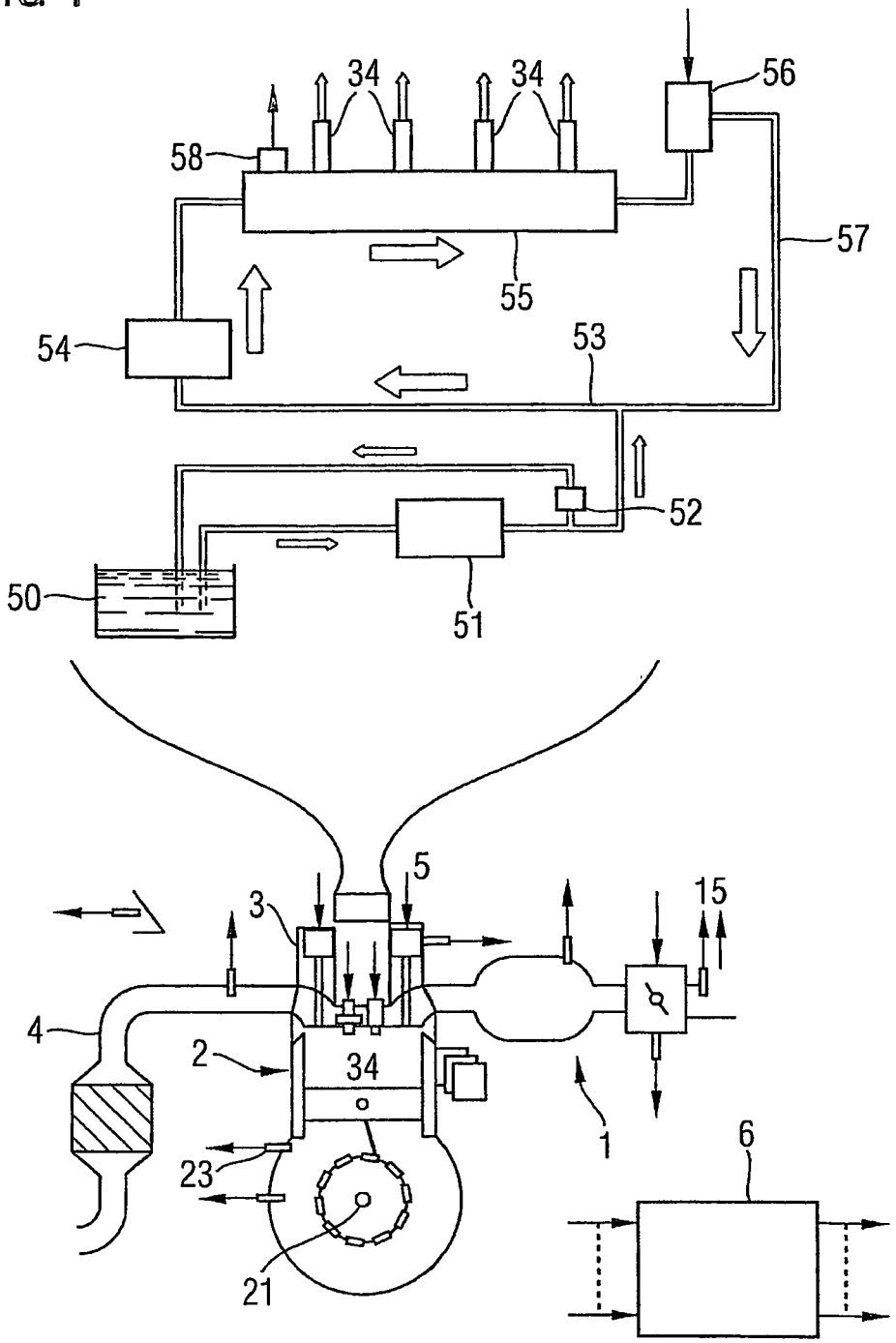
FIG. 1 shows an internal combustion engine with a fuel supply device.

Elements of identical construction and function are identified with the same reference characters throughout the Figures.

An internal combustion engine (FIG. 1) comprises an intake tract 1, an engine block 2, a cylinder head 3 and an exhaust tract 4. The engine block comprises a plurality of cylinders having pistons and connecting rods via which they are linked to a crankshaft 21.

The cylinder head comprises a valve train with an inlet valve, an outlet valve and valve operating mechanisms. The cylinder head 3 additionally comprises an injection valve 34 and a spark plug. Alternatively the injection valve can also be disposed in the intake tract 1.

A fuel supply device 5 is additionally provided, comprising a fuel tank 50 which is connected to a low pressure pump 51 via a first fuel line. On the output side the low pressure pump 51 is actively connected to an inlet pipe 53 of a high pressure pump 54. In addition, on the output side of the low pressure pump 51 there is also provided a mechanical regulator 52 which is connected on the output side to the tank via another fuel line. The mechanical regulator is preferably a simple spring-loaded valve acting as a kind of non-return valve, the spring constant then being selected in such a way that a specified low pressure is not exceeded in the inlet pipe 53. The low pressure pump 51 is preferably designed in such a way that, during operation, it always delivers sufficient fuel to ensure that the pressure does not fall below the specified low pressure.

The inlet pipe 53 feeds into a high pressure pump 54 which, on the output side, delivers fuel to a fuel accumulator 55. The high pressure pump 54 is generally driven by the crankshaft 21 or the camshaft and therefore delivers a constant volume of fuel to the fuel accumulator 55 at constant speed of the crankshaft 21.

The injection valves 34 are actively connected to the fuel accumulator 55. The fuel is therefore supplied to the injection valves 34 via the fuel accumulator 55.

In addition, an electromagnetic regulator 56 is actively connected to the fuel accumulator 55. Via said electromagnetic regulator 56, fuel can flow back from the fuel accumulator 55 to the inlet pipe 53 along a return line 57. The electromagnetic regulator has a cylindrical core with a cylinder coil having a cylindrical cavity inside. In said cylindrical cavity there is mounted a cylindrical armature with a guide rod which then, depending on its position, clears to a greater or lesser extent the free flow cross-section of the accumulator 55 in the direction of the return line 57. The design of the electromagnetic regulator therefore corresponds to that of a plunger-type armature. Depending on the cylinder coil energization set, the force characteristic for displacing the cylindrical armature is thus set in accordance with a variable spring constant. This means that the fuel pressure in the accumulator 55 can be adjusted as a function of the actuating signal with which the electromagnetic regulator 56 is controlled, i.e. as a function of the energization, for example.

The opening cross-section of the regulator valve therefore depends on the one hand on the magnetic force acting on the cylindrical armature and, on the other, on the force depending on the actual value of the fuel pressure in the fuel accumulator 55. Moreover, counteracting frictional forces also affect the movement of the armature. In addition, the armature also has a non-negligible inertia which, in the event of flow variations in the regulator, allows no immediate position change of the valve tappet connected to the armature, which tappet clears to a greater or lesser extent the free cross-section for the flow of fuel from the fuel accumulator 55 toward the return line 57. Because of these forces, the electromagnetic regulator provides hysteresis if the flow of fuel exhibits dynamics which, without intervention, may result in fuel pressure peaks.

In addition, the internal combustion engine is assigned a control device 6 to which sensors are in turn assigned which detect various measured variables and determine the measured value of the measured variable in each case. As a function of at least one of the measured variables, the control device 6 determines manipulated variables which are then converted into actuating signals for controlling the control elements by means of corresponding actuators. The sensors are a pedal position sensor which detects the position of a gas pedal, a temperature sensor which detects the intake air temperature T_IM, a crankshaft angle sensor which detects a crankshaft angle and to which a speed is then assigned, another temperature sensor 23 which detects a coolant temperature TCO and a pressure sensor 58 which detects the fuel pressure FUP_AV in the fuel accumulator 55. Depending on the embodiment of the invention, any subset of the sensors or even additional sensors may be present.

The control elements are, for example, inlet or outlet valves, the injection valves 34, a spark plug, a throttle valve or even the electromagnetic regulator 56.

To control the fuel pressure in the fuel supply device 5 of the internal combustion engine, a program which is loaded and then executed during operation of the internal combustion engine is stored in the control device 6.

Figure 2:
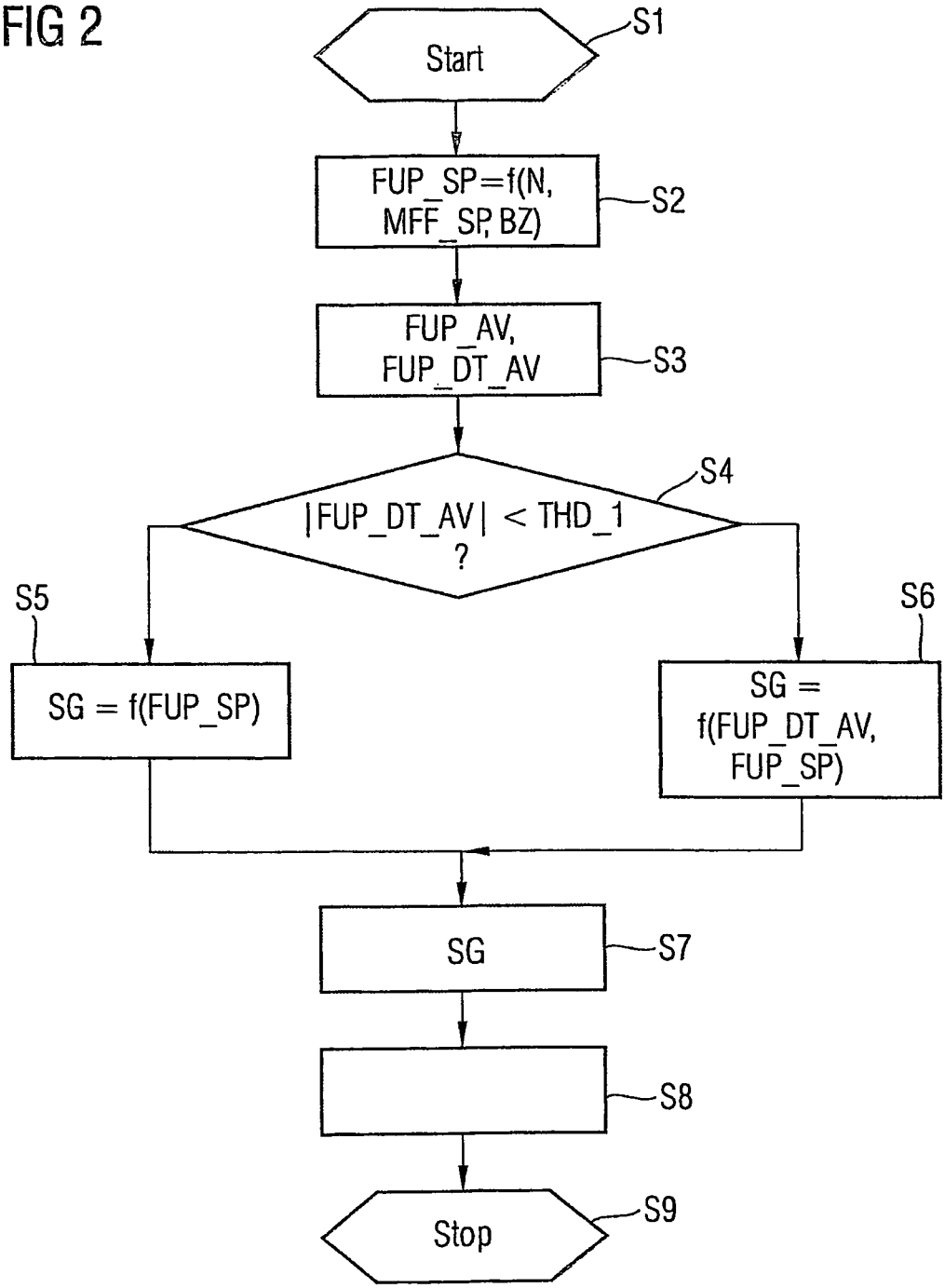
FIG. 2 shows a flowchart for a program for controlling a fuel pressure in the fuel supply device of an internal combustion engine according to FIG. 1.

The flowchart of the program for controlling the fuel pressure in the supply device 5 will now be described with reference to FIG. 2 and the flowchart shown therein. The program is initiated in a step S1. This preferably takes place for the first time when the engine is started and the program is then restarted and executed at specified intervals or after specified events, such as after a specified crankshaft angle.

In a step S2, a fuel pressure set point FUP_SP is determined as a function of the engine speed N, the amount of fuel to be injected MFF_SP and the operating state BZ of the internal combustion engine, e.g. homogeneous or stratified charge operation. In a step S3, the actual fuel pressure value FUP_AV which is detected by the pressure sensor 58 is determined and from it the fuel pressure gradient FUP_DT_AV is determined. The gradient, which is also known as the time derivative, can be determined by means of any approximation method. It is most easily determined as a function of two consecutive actual fuel pressure values FUP_AV.

In a step S4, it is checked whether the absolute value of the fuel pressure gradient FUP_DT_AV is less than a first threshold value THD_1. If this is the case, it indicates that the dynamics of the flow of fuel through the electromagnetic regulator 56 are low. If the condition of step S4 is satisfied, the actuating signal SG for the electromagnetic regulator is determined as a function of the fuel pressure set point FUP_SP in a step S5.

However, if the condition of step S4 is not satisfied, the actuating signal SG is determined as a function of the set point FUP_SP and the gradient FUP_DT_AV in a step S6, the actuating signal preferably being reduced in the event of a rise in the fuel pressure, indicated by a positive fuel pressure gradient FUP_DT_AV, and increased in the event of a fall in the fuel pressure, indicated by a negative fuel pressure gradient FUP_DT_AV, the actuating signal SG preferably being determinable as a function of the fuel pressure gradient FUP_DT_AV and fuel pressure set point FUP_SP by means of interpolation using an engine map.

In a step S7, the actuating signal SG is then fed out to the electromagnetic regulator 56. The energization of the electromagnetic regulator 56 is preferably influenced by the actuating signal, to which end the pulse width modulation of a voltage signal with which the electromagnetic regulator 56 is controlled is preferably varied as a function of the value of the actuating signal SG.

In a step S9, the program is then terminated and restarted in step S1 after a predetermined waiting time or the occurrence of the above-mentioned conditions. Alternatively, the variable characterizing the dynamics of the flow of fuel through the regulator valve can also directly be the variation in the flow rate through the electromagnetic regulator 56. This flow can be detected, for example, by means of a flow sensor disposed in the return line 57 and from it a corresponding flow gradient can likewise be determined which is then used for determining the actuating signal SG if the flow dynamics fall below a specified threshold value.

Figure 3:
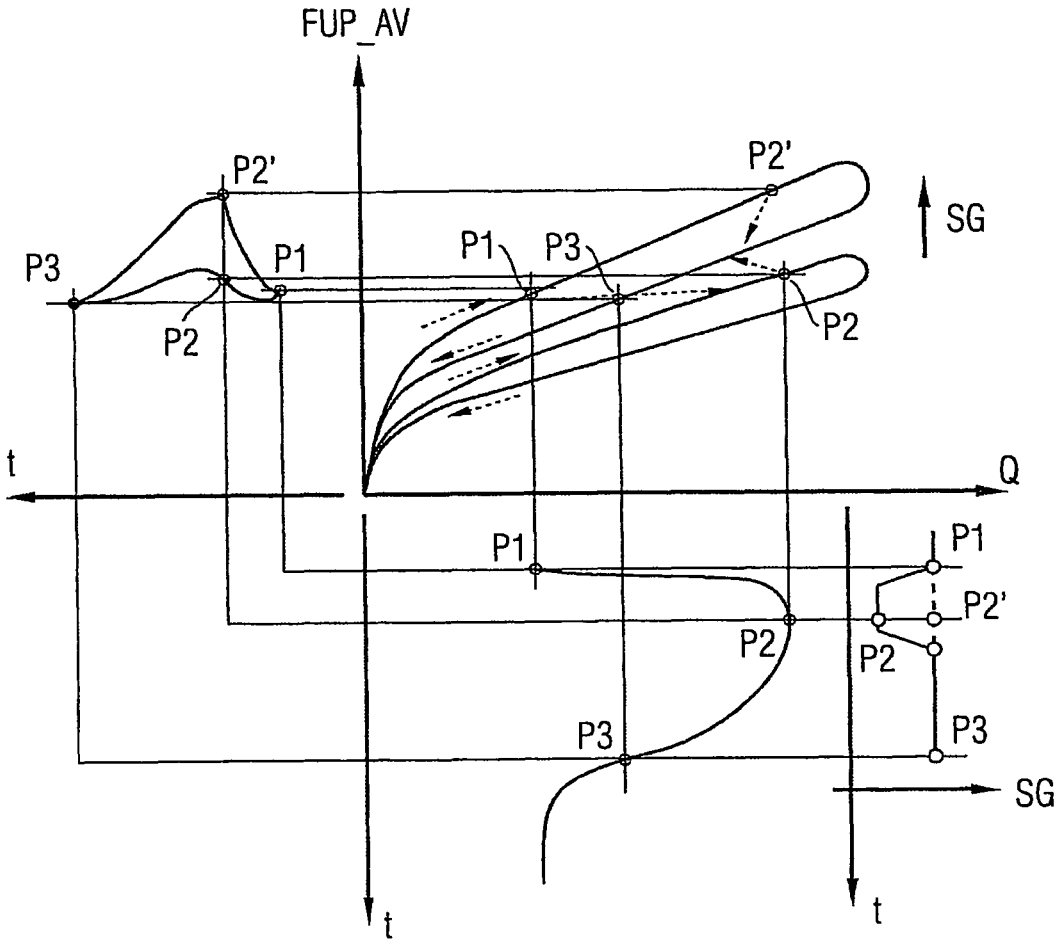
FIG. 3 shows typical characteristics of the fuel pressure and flow rate at the regulator valve.

FIG. 3 shows on the one hand the characteristic of the actual fuel pressure value FUP_AV as a function of the flow Q through an electromagnetic regulator 56. The two hysteresis-shaped fuel pressure curves plotted as a function of the flow Q are shown for two different values of the actuating signal. In the case of the value of the actuating signal SG set for point P1, the plotted time characteristic of the actual fuel pressure value FUP_AV over the time axis t relative to the points P1, P2' and P3 is obtained. However, the variation in fuel pressure of the actual fuel pressure value FUP_AV from point P1 to point P2 is greater than the value predetermined by the first threshold value THD1 in step S4 for the absolute value of the gradient FUP_DT_AV. This means that the actuating signal is reduced even before reaching point P2, as is likewise plotted in FIG. 2 on the basis of point P2 as a function of the time t and the actuating signal SG. This then produces the pressure characteristic of the actual value FUP_AV over time along points P1, P2 and P3. The pressure characteristic is therefore much more uniform than for points P1, P2' and P3.

The gradient FUP_DT_AV attains particularly high absolute values if the operating state of the engine goes from normal mode to idling or overrun cutoff, i.e. disconnection of the fuel supply to the engine's cylinders via the injection valves 34, or vice versa. In these cases, the outflow of fuel from the fuel accumulator through the injection valves changes very rapidly, resulting in a very large variation in the flow through the electromagnetic regulator 56 with the output of the high pressure pump 54 remaining virtually unchanged. It is precisely in the event of such operating state transitions that any severe overshoot or undershoot of the actual fuel pressure value FUP_AV is effectively prevented by the program according to FIG. 2. In this way it can also be ensured that the engine exhaust emissions can be minimized even under these operating conditions.

The invention claimed is:

1. A method for controlling a fuel pressure in a fuel supply device of an internal combustion engine having a regulator valve, the method comprising the steps of:

determining a desired fuel pressure value;

determining an actual fuel pressure value by a fuel pressure sensor;

calculating an actual fuel pressure gradient from at least two consecutive actual fuel pressure values from said fuel pressure sensor, wherein the actual fuel pressure gradient represents the first derivative of the actual fuel pressure;

comparing the calculated actual fuel pressure gradient representing the first derivative of the actual fuel pressure to a specified threshold gradient value; and if the calculated actual fuel pressure gradient is positive indicating a rise in fuel pressure, and the absolute value of the calculated actual fuel pressure gradient is above the specified threshold gradient value, then decreasing a magnitude of an actuating signal based on the desired fuel pressure value and the calculated positive actual fuel pressure gradient;

if the calculated actual fuel pressure gradient is negative indicating a drop in fuel pressure, and the absolute value of the calculated actual fuel pressure gradient is above the specified threshold gradient value, then increasing the magnitude of the actuating signal based on the desired fuel pressure value and the calculated negative actual fuel pressure gradient;

if the absolute value of the calculated actual fuel pressure gradient is below the specified threshold gradient value, increasing or decreasing the actuating signal based on the desired fuel pressure value but not the calculated actual fuel pressure gradient; and controlling said regulator valve with said decreased or increased actuating signal;

wherein the desired fuel pressure value represents a fuel pressure, in contrast to the calculated actual fuel pressure gradient, which represents a change in fuel pressure over time.

2. A method for controlling a fuel pressure or flow rate in a fuel supply device of an internal combustion engine, wherein the supply device has a fuel pump that pumps a fuel into a fuel accumulator that supplies injection valves with the fuel, wherein the fuel accumulator comprises a sensor and is connected to a regulator valve that adjusts the fuel pressure as a function of an actuating signal comprising the steps of:

determining a desired fuel pressure or flow rate value;

determining an actual fuel pressure or flow rate value by means of said sensor;

calculating an actual gradient from at least two consecutive actual fuel pressure or flow rate values, wherein the actual fuel pressure gradient represents the first derivative of the actual fuel pressure;

if the calculated actual gradient is positive, indicating a rise in fuel pressure:

comparing the calculated actual gradient representing the first derivative of the actual fuel pressure to a specified upper threshold gradient value; and if the calculated actual gradient is above the specified upper threshold gradient value, then decreasing a magnitude of an actuating signal based on the desired fuel pressure or flow rate value and the calculated positive actual gradient;

if the calculated actual gradient is negative, indicating a fall in fuel pressure:

comparing the calculated actual gradient representing the first derivative of the actual fuel pressure to a specified lower threshold gradient value; and if the calculated actual gradient is above the specified lower threshold gradient value, then increasing the magnitude of the actuating signal based on the desired fuel pressure or flow rate value and the calculated positive actual gradient;

if the absolute value of the calculated actual fuel pressure gradient is below the specified threshold gradient value, increasing or decreasing the actuating signal based on the desired fuel pressure value but not the calculated actual fuel pressure gradient; and controlling said regulator valve with said decreased or increased actuating signal;

wherein the desired fuel pressure or flow rate value represents a fuel pressure or flow rate, in contrast to the calculated actual gradient, which represents a change in fuel pressure or flow rate over time.

3. The method according to claim 2, wherein the regulator valve is an electromagnetic regulator and an energization of the electromagnetic regulator is influenced by the actuating signal.

4. The method according to claim 3, wherein the step of controlling said regulator valve with said actuating signal includes:

if the flow rate increases, decreasing an energization of the electromagnetic regulator; and if the flow rate falls, increasing the energization of the electromagnetic regulator.

5. The method according to claim 3, wherein the step of controlling said regulator valve with said actuating signal includes:

if the fuel pressure increases, decreasing the energization of the electromagnetic regulator; and if the fuel pressure falls, increasing the energization of the electromagnetic regulator.

6. The method according to claim 4, wherein the step of controlling said regulator valve with said actuating signal includes:

if the fuel pressure increases, decreasing the energization of the electromagnetic regulator; and if the fuel pressure falls, increasing the energization of the electromagnetic regulator.

7. The method according to claim 1, wherein the regulator valve is an electromagnetic regulator and an energization of the electromagnetic regulator is influenced by the actuating signal.

8. The method according to claim 2, wherein the step of controlling said regulator valve with said actuating signal includes:

if the flow rate increases, decreasing an energization of the electromagnetic regulator; and if the flow rate falls, increasing the energization of the electromagnetic regulator.

9. The method according to claim 7, wherein the step of controlling said regulator valve with said actuating signal includes:

if the fuel pressure increases, decreasing the energization of the electromagnetic regulator; and if the fuel pressure falls, increasing the energization of the electromagnetic regulator.

10. The method according to claim 8, wherein the step of controlling said regulator valve with said actuating signal includes:

if the fuel pressure increases, decreasing the energization of the electromagnetic regulator, and if the fuel pressure falls, increasing the energization of the electromagnetic regulator.

11. The method according to claim 1, further comprising if the calculated actual gradient is below said specified threshold gradient value then determining the actuating signal as a function of the desired fuel pressure value.

12. A method for controlling a fuel flow rate in a fuel supply device of an internal combustion engine having a regulator valve, the method comprising the steps of:

determining a desired fuel flow rate;

determining an actual fuel flow rate;

calculating an actual fuel flow rate gradient from at least two consecutive actual fuel flow rates, wherein the actual fuel pressure gradient represents the first derivative of the actual fuel pressure;

comparing the calculated actual flow rate gradient representing the first derivative of the actual fuel pressure to a specified threshold gradient value; and if the calculated actual fuel flow gradient is positive indicating a rise in fuel flow, and the absolute value of the calculated actual fuel flow gradient is above the specified threshold gradient value, then decreasing a magnitude of an actuating signal based on the desired fuel flow rate and the calculated positive actual fuel flow gradient;

if the calculated actual fuel flow gradient is negative indicating a drop in fuel flow, and the absolute value of the calculated actual fuel flow gradient is above the specified threshold gradient value, then increasing the magnitude of the actuating signal based on the desired fuel flow rate and the calculated negative actual fuel flow gradient;

if the absolute value of the calculated actual fuel pressure gradient is below the specified threshold gradient value, increasing or decreasing the actuating signal based on the desired fuel pressure value but not the calculated actual fuel pressure gradient; and controlling said regulator valve with said decreased or increased actuating signal;

wherein the desired fuel flow rate represents a flow rate, in contrast to the calculated actual fuel flow rate, which represents a change in flow rate over time.

13. The method according to claim 12, wherein the actual fuel flow rate is determined by means of a flow sensor.

14. The method according to claim 1, further comprising the step of supplying fuel injectors with fuel having the fuel pressure regulated by said regulator valve.

15. The method according to claim 2, further comprising the step of supplying fuel injectors with the fuel having the fuel pressure or flow rate regulated by said regulator valve.

16. The method according to claim 12, further comprising the step of supplying fuel injectors with fuel having the fuel flow rate regulated by said regulator valve.

* * * * *